US009847187B2

(12) United States Patent
Kanemoto et al.

(10) Patent No.: US 9,847,187 B2
(45) Date of Patent: Dec. 19, 2017

(54) OPERATING MEMBER, AND METHOD OF MANUFACTURING OPERATING PORTION OF OPERATING MEMBER

(71) Applicant: DENSO CORPORATION, Kariya, Aichi-pref. (JP)

(72) Inventors: Takeo Kanemoto, Kariya (JP); Yasuhiko Yamazaki, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/104,208

(22) PCT Filed: Jan. 21, 2015

(86) PCT No.: PCT/JP2015/000256
§ 371 (c)(1),
(2) Date: Jun. 13, 2016

(87) PCT Pub. No.: WO2015/115063
PCT Pub. Date: Aug. 6, 2015

(65) Prior Publication Data

US 2017/0032907 A1 Feb. 2, 2017

(30) Foreign Application Priority Data

Jan. 30, 2014 (JP) ..... 2014-015610

(51) Int. Cl.
*H01H 3/08* (2006.01)
*H01H 19/00* (2006.01)
(Continued)

(52) U.S. Cl.
CPC ..... *H01H 13/14* (2013.01); *H01H 11/00* (2013.01); *H01H 19/14* (2013.01); *H01H 3/08* (2013.01);
(Continued)

(58) Field of Classification Search
CPC ..... H01H 3/00; H01H 3/12; H01H 13/00; H01H 13/14; H01H 13/26; H01H 13/50;
(Continued)

(56) References Cited

U.S. PATENT DOCUMENTS 7,671,291 B2 * 3/2010 Odanaka ..... H01H 13/70 200/345
2007/0137359 A1 6/2007 Ohno et al.

FOREIGN PATENT DOCUMENTS

IT EP 0820080 A1 * 1/1998 ..... H01H 3/122
JP S5287312 U 6/1977
(Continued)

*Primary Examiner* — Anthony R. Jimenez
(74) *Attorney, Agent, or Firm* — Harness, Dickey & Pierce, P.L.C.

(57) ABSTRACT

An operating member includes: a body portion; an operating portion connected to the body portion; an engaging portion arranged in the body portion; an engaged portion arranged in the operating portion, and engaged with the engaging portion to connect the body portion and the operating portion; a piece portion arranged in a back surface portion of the operating portion and protruding toward the body portion; a piece-portion hole arranged in the body portion, into which the piece portion is inserted; and a protruding portion made of an elastic material, arranged in the piece portion, protruding from a side of the piece portion, and press-contacting an edge portion of the piece-portion hole when the piece portion is inserted into the piece-portion hole.

6 Claims, 12 Drawing Sheets

(51) Int. Cl.

| | |
|---|---|
| ***H01H 19/14*** | (2006.01) |
| ***H01H 21/00*** | (2006.01) |
| ***H01H 13/14*** | (2006.01) |
| ***H01H 11/00*** | (2006.01) |
| *H01H 3/12* | (2006.01) |

(52) U.S. Cl.
CPC ..... *H01H 3/12* (2013.01); *H01H 2231/026* (2013.01)

(58) Field of Classification Search
CPC .... H01H 13/52; H01H 13/70; H01H 2003/12; H01H 13/12; H01H 11/00; H01H 19/14; H01H 3/08; H01H 2231/06; H01H 13/02
USPC ..... 200/5 A, 341, 329, 343, 344, 520, 521, 200/336
See application file for complete search history.

(56) References Cited

FOREIGN PATENT DOCUMENTS

| | | | |
|---|---|---|---|
| JP | H0658538 | U | 8/1994 |
| JP | H0963399 | A | 3/1997 |
| JP | 2002313176 | A | 10/2002 |
| JP | 2007080590 | A | 3/2007 |
| JP | 2007090979 | A | 4/2007 |
| JP | 2010123541 | A | 6/2010 |

* cited by examiner

OPERATING MEMBER, AND METHOD OF MANUFACTURING OPERATING PORTION OF OPERATING MEMBER

CROSS REFERENCE TO RELATED APPLICATIONS

This application is a U.S. National Phase Application under 35 U.S.C. 371 of International Application No. PCT/JP2015/000256 filed on Jan. 21, 2015 and published in Japanese as WO 2015/115063 A1 on Aug. 6, 2015. This application is based on and claims the benefit of priority from Japanese Patent Application No. 2014-015610 filed on Jan. 30, 2014. The entire disclosures of all of the above applications are incorporated herein by reference.

TECHNICAL FIELD

The present disclosure relates to an operating member for vehicle equipment and the like, and a method of manufacturing an operating portion of the operating member.

BACKGROUND ART

In the related art, a vehicle includes vehicle equipment such as a car navigation apparatus, an audio apparatus, and an air conditioning apparatus. The vehicle equipment includes an operating member for inputting various commands. The operating member is configured to include a body portion and an operating portion provided on a surface side of the body portion. In this case, an engaged hook is provided in one of the body portion and the operating portion, and an engaging hole portion is provided in the other. The body portion and the operating portion are joined together by engagement between the engaged hook and an edge of the engaging hole portion.

In this configuration, when a very small gap is present between the engaged hook and the edge of the engaging hole portion, and an operator operates the operating portion, the operating portion and the body portion wobble relative to each other, which is a problem.

PRIOR ART LITERATURES

Patent Literature

Patent Literature 1: JP-2010-123541

SUMMARY OF INVENTION

It is an object of the present disclosure to provide an operating member configured to include a body portion and an operating portion, and a method of manufacturing the operating portion of the operating member in which wobbling during an operation can be prevented According to a first aspect of the present disclosure, an operating member includes: a body portion; an operating portion connected to the body portion; an engaging portion arranged in the body portion; an engaged portion arranged in the operating portion, and engaged with the engaging portion to connect the body portion and the operating portion; a piece portion arranged in a back surface portion of the operating portion and protruding toward the body portion; a piece-portion hole arranged in the body portion, into which the piece portion is inserted; and a protruding portion made of an elastic material, arranged in the piece portion, protruding from a side of the piece portion, and press-contacting an edge portion of the piece-portion hole when the piece portion is inserted into the piece-portion hole.

In the operating member, the body portion and the operating portion are joined together by engagement of the engaging portions with the respective engaged portions. The piece portion of the operating portion is inserted into the piece-portion hole portion of the body portion. At this time, the protruding portion made of an elastic material and protruding from the side surface of the piece portion comes into press contact with an inner edge portion of the piece-portion hole portion. Accordingly, wobbling between the body portion and the operating portion during operation can be prevented.

Alternatively, the operating portion may include an operating-portion main body and an exterior body made of an elastic material and fixed to a front surface portion of the operating-portion main body. The engaged portion is arranged in the operating-portion main body. The piece portion is arranged in a back surface portion of the operating-portion main body. The operating-portion main body includes a through hole arranged in a portion of the operating-portion main body corresponding to a base portion of the piece portion and penetrating from the front surface portion to the back surface portion of the operating-portion main body, and a plug space portion communicating with the through hole and opening to a middle portion of the piece portion. A portion of the exterior body is continuously plugged into and fixed to the through hole and the plug space portion, and the portion of the exterior body fixed to the plug space portion provides the protruding portion protruding from the side of the piece portion.

In the case described above, the operating portion is configured to include the operating-portion main body, and the exterior body which is made of an elastic material and is firmly fixed to the upper surface portion of the operating-portion main body. Since the hand and fingers of a user come into contact with the exterior body made of an elastic material in this configuration, the exterior body is well fitted to the hand and fingers, and improved ease of use is obtained. Since a portion of the exterior body is continuously plugged into, and firmly fixed to the through hole portion and the plug space portion of the operating-portion main body, and a portion of the exterior body firmly fixed to the plug space portion forms the protruding portion protruding from the side surface of the piece portion, the protruding portion can be formed on an upper surface portion side of the operating-portion main body by using the exterior body configured to improve ease of use. Since the protruding portion is plugged into and firmly fixed to the plug space portion of the piece portion, when the piece portion is inserted into the piece-portion hole portion, the protruding portion can also be integrally (without being offset from the piece portion) pressed into the piece-portion hole portion, and reliably comes into press contact with the inner edge portion of the piece-portion hole portion. Accordingly, wobbling between the body portion and the operating portion during operation can be reliably prevented.

According to a second aspect of the present disclosure, a method of manufacturing an operating portion of an operating member, which includes: a body portion; an operating portion including an operating-portion main body and an exterior body made of an elastic material and fixed to a front surface portion of the operating-portion main body, and connected to the body portion; an engaging portion arranged in the body portion; an engaged portion arranged in the operating-portion main body, and engaged with the engaging portion to connect the body portion and the operating portion; a piece portion arranged in a back surface portion of the operating-portion main body, and protruding toward the body portion; and a piece-portion hole arranged in the body portion, into which the piece portion is inserted, the operating-portion main body including a through hole arranged in a portion of the operating-portion main body corresponding to a base portion of the piece portion and penetrating from the front surface portion to the back surface portion of the operating-portion main body, and a plug space portion communicating with the through hole and opening to a middle portion of the piece portion, a portion of the exterior body being continuously plugged into and fixed to the through hole and the plug space portion, the portion of the exterior body fixed to the plug space portion providing a protruding portion protruding from the side of the piece portion, and the protruding portion press-contacting an edge portion of the piece-portion hole when the piece portion is inserted into the piece-portion hole, the method of manufacturing the operating portion of the operating member includes: die molding the operating-portion main body with a first die and a second die, which are separable from each other and provide a cavity for the operating-portion main body; separating the second die from the first die; die matching the first die, on which the operating-portion main body remains, with a separable third die for providing a cavity for the exterior body using the first die and the operating-portion main body; and die molding and fixing the exterior body to the operating-portion main body using the first die, the operating-portion main body and the third die.

In the operating portion manufacturing method for manufacturing the operating portion, the body portion and the operating portion are joined together by engagement of the engaging portions with the respective engaged portions. The piece portion of the operating portion is inserted into the piece-portion hole portion of the body portion. At this time, the protruding portion made of an elastic material and protruding from the side surface of the piece portion comes into press contact with the inner edge portion of the piece-portion hole portion. Accordingly, wobbling between the body portion and the operating portion during operation can be prevented.

In addition, the operating portion is configured to include the operating-portion main body, and the exterior body which is made of an elastic material and is firmly fixed to the upper surface portion of the operating-portion main body. Since the hand and fingers of a user come into contact with the exterior body made of an elastic material in this configuration, the exterior body is well fitted to the hand and fingers, and improved ease of use is obtained. Since a portion of the exterior body is continuously plugged into, and firmly fixed to the through hole portion and the plug space portion of the operating-portion main body, and a portion of the exterior body firmly fixed to the plug space portion forms the protruding portion protruding from the side surface of the piece portion, the protruding portion can be formed on an upper surface portion side of the operating-portion main body by using the exterior body configured to improve ease of use. Since the protruding portion is plugged into and firmly fixed to the plug space portion of the piece portion, when the piece portion is inserted into the piece-portion hole portion, the protruding portion can also be integrally (without being offset from the piece portion) pressed into the piece-portion hole portion, and reliably comes into press contact with the inner edge portion of the piece-portion hole portion. Accordingly, wobbling between the body portion and the operating portion during operation can be reliably prevented.

BRIEF DESCRIPTION OF DRAWINGS

The above and other objects, features and advantages of the present disclosure will become more apparent from the following detailed description made with reference to the accompanying drawings. In the drawings:

FIG. 10 is a cross-sectional view of the operating member taken along line Z10-Z10 in FIG. 9;

EMBODIMENTS FOR CARRYING OUT INVENTION

Figure 1:
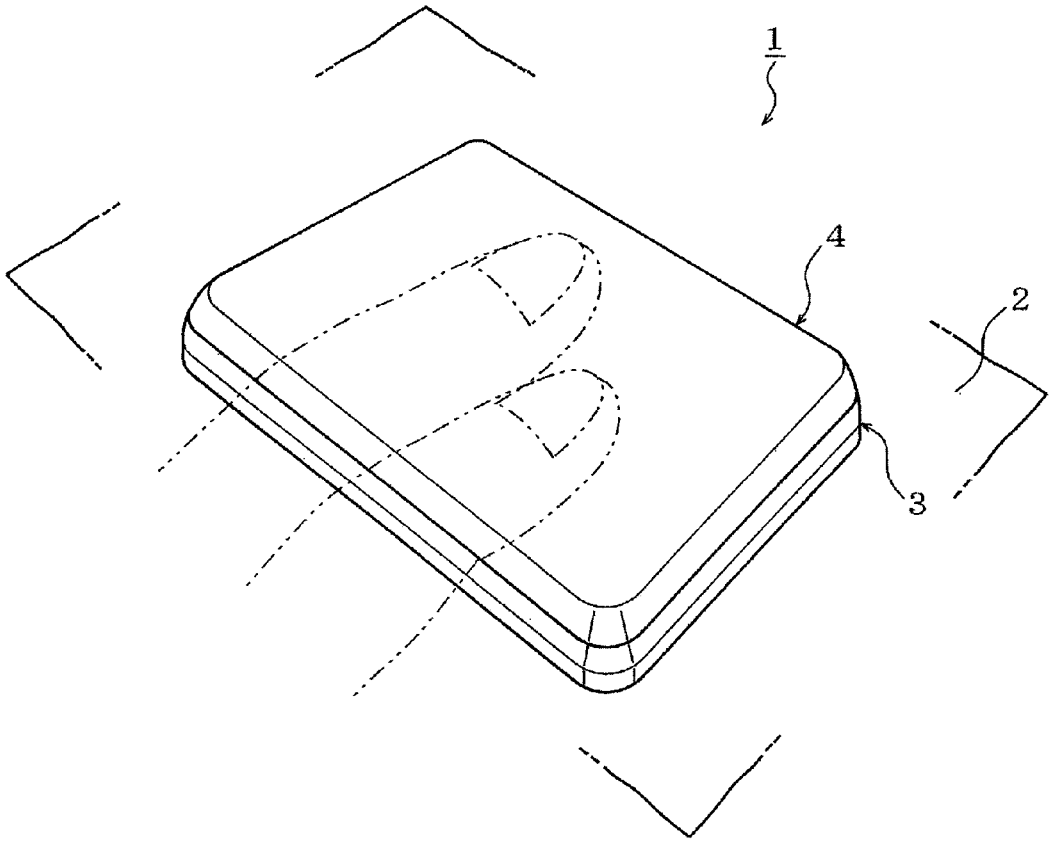
FIG. 1 is a perspective view of an operating member in a first embodiment of the present disclosure.
Figure 2:
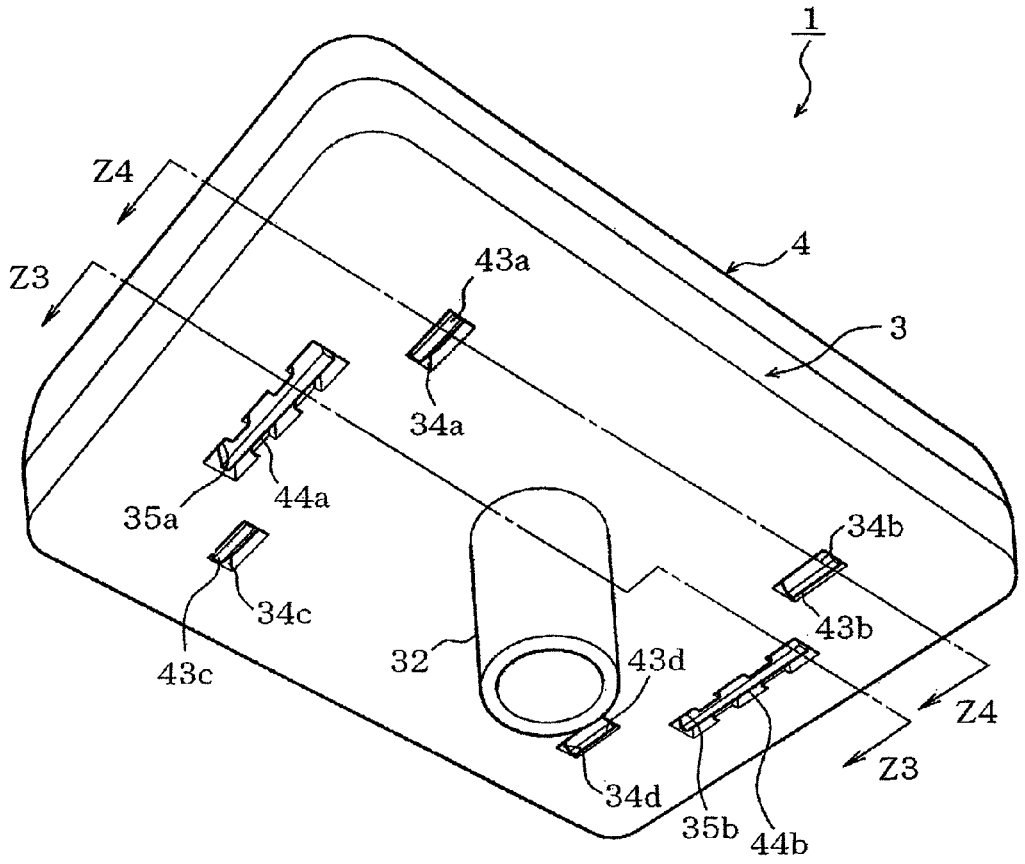
FIG. 2 is a perspective view of the operating member seen from below.

Hereinafter, a first embodiment of the present disclosure will be described with reference to FIGS. 1 to 11C. An operating member 1 illustrated in FIG. 1 is an operating member for a car navigation device in a vehicle. The operating member 1 is provided in a panel 2 in the vicinity of an arm rest beside a driver's seat such that the operating member 1 can be operated in an arbitrary direction. An operator can perform various settings and selections on a monitor screen by operating the operating member 1.

As illustrated in FIGS. 1 to 5, the operating member 1 includes a body portion 3 and an operating portion 4 joined to the body portion 3. The body portion 3 is formed of hard synthetic resin (ABS resin or the like) by die molding. The body portion 3 includes a body-portion main body 31 having a substantially rectangular flat plate-like shape. A rising portion 32 is provided from a circumferential edge portion of the body-portion main body 31 to form a substantially mountain-like shape. A cylindrical operator 33 is provided in a lower surface portion (back surface portion) of the body-portion main body 31. A circular stepped portion 33*a* is provided in an upper surface portion of the body-portion main body 31, and has a flat upper surface corresponding to the operator 33.

Figure 5:
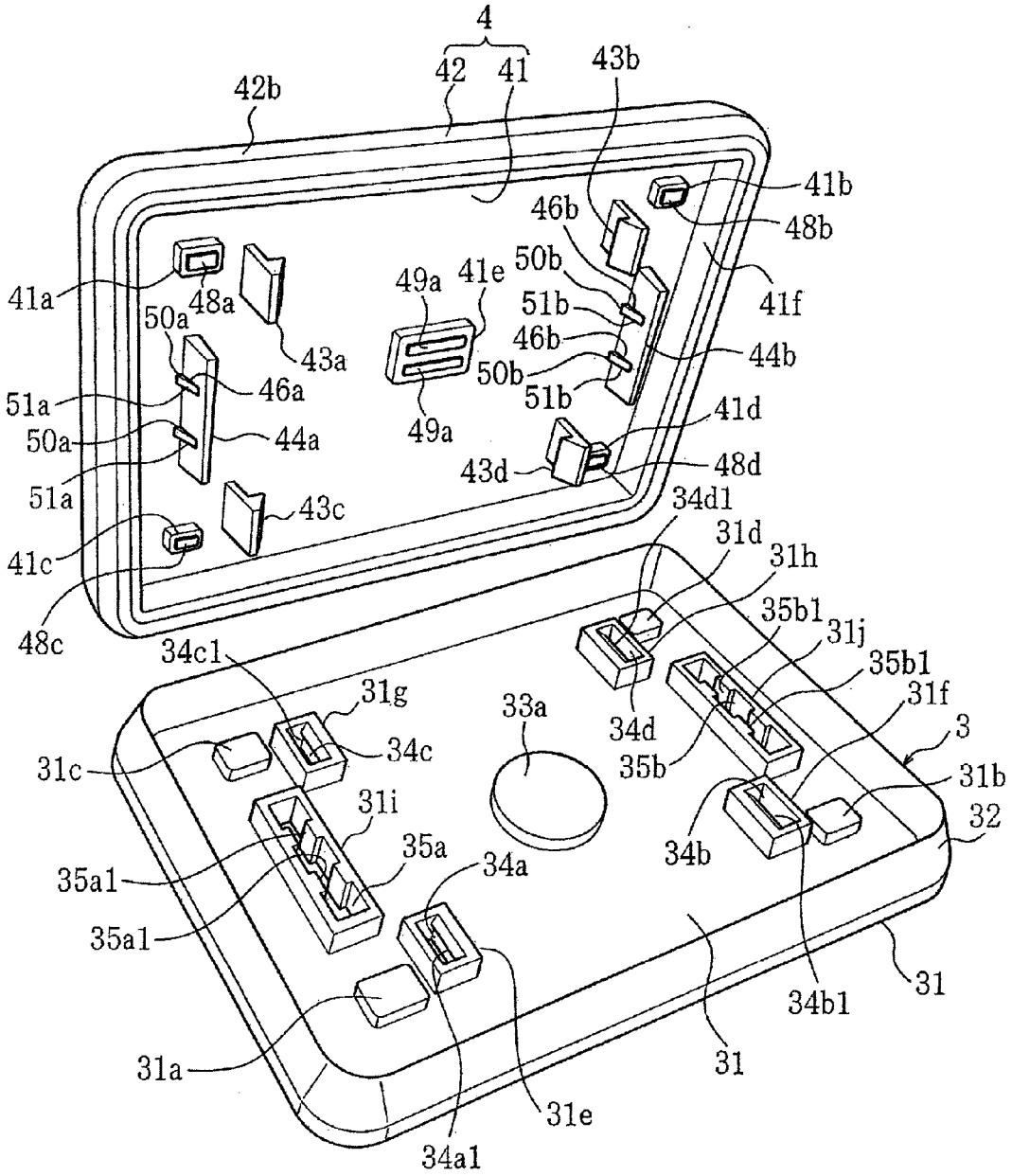
FIG. 5 is a perspective view illustrating a body portion and an operating portion which are separated from each other.

As illustrated in FIG. 5, substantially rectangular stepped portions 31*a* to 31*d*, each of which has a flat upper surface, are respectively provided in four corner portions of the upper surface portion of the body-portion main body 31.

Stepped portions 31*e* to 31*h* are provided close to the four corner portions of the body-portion main body 31. Four engaging hole portions 34*a* to 34*d* as engaging portions are respectively provided to vertically pass through the stepped portions 31*e* to 31*h*, and portions of the body-portion main body 31 corresponding to the respectively stepped portions 31*e* to 31*h*. Locking portions 34*a*1 to 34*d*1 (refer to FIGS. 4 and 5) are respectively provided in inner surface portions of the engaging hole portions 34*a* to 34*d*.

Separate stepped portions 31*j* and 31*i* are respectively formed in right and left portions of the body-portion main body 31. Piece-portion hole portions 35*a* and 35*b*, each of which has an elongated shape in a top view, are respectively provided to vertically pass through the stepped portions 31*i* and 31*j*, and portions of the body-portion main body 31 corresponding thereto. Protruding portions 35*a*1 facing each other are provided at two locations in the piece-portion hole portion 35*a*. The width of a gap between the protruding portions 35*a* facing each other is narrow. Similarly, protruding portions 35*b*1 are formed in the other piece-portion hole portion 35*b*.

Figure 3:
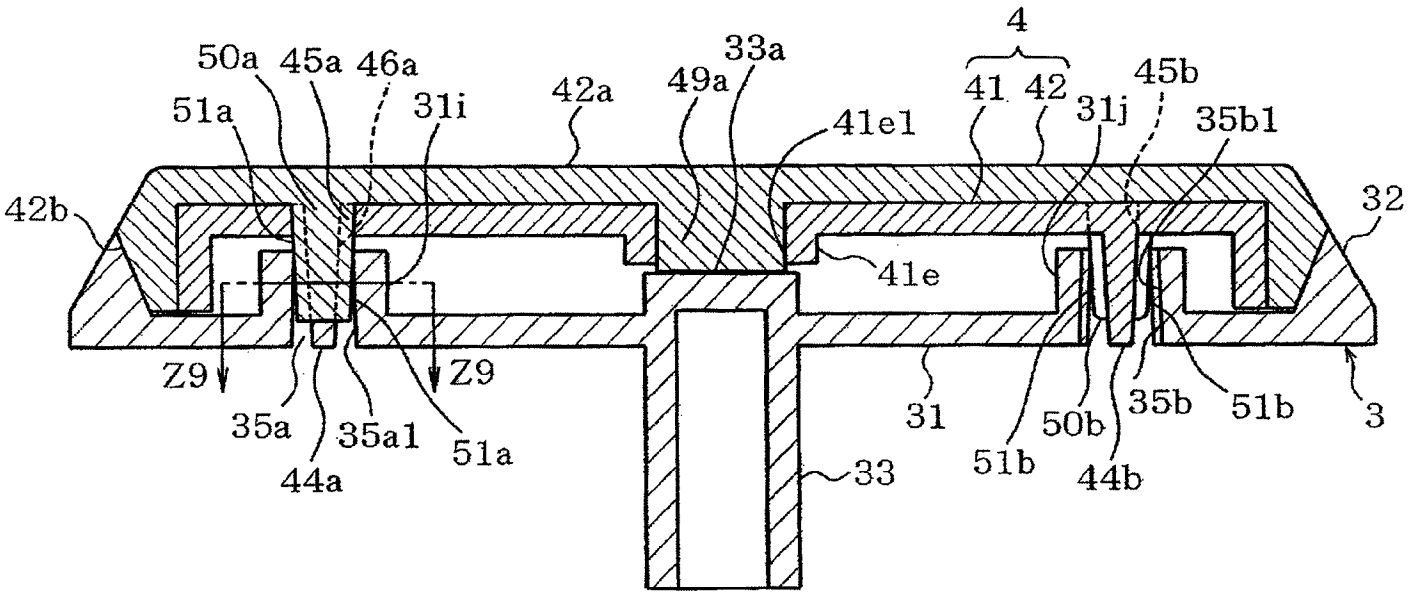
FIG. 3 is a cross-sectional view of the operating member taken along line Z3-Z3 in FIG. 2.

As illustrated in FIGS. 3 and 10, inner surfaces of each of the piece-portion hole portions 35*a* and 35*b*, and the protruding portions 35*a*1 and 35*b*1 are disposed to form a vertical tapered shape from the viewpoint of mold release. Accordingly, a gap between the protruding portions 35*a*1 facing each other is decreased toward an upper side. Similarly, a gap between the protruding portions 35*b*1 is decreased toward the upper side.

The operating portion 4 is configured to include an operating-portion main body 41, and an exterior body 42 which is made of an elastic material such as elastomer and is firmly fixed to an upper surface portion of the operating-portion main body 41.

Figure 6:
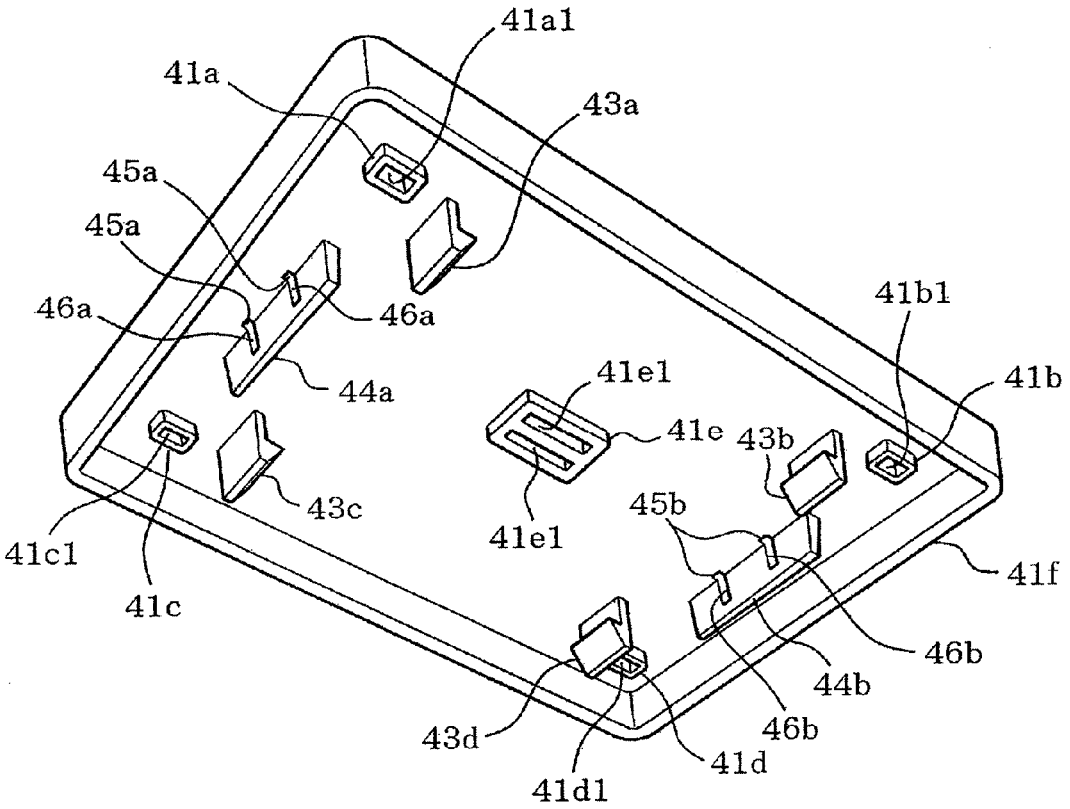
FIG. 6 is a perspective view of an operating-portion main body seen from below.
Figure 7:
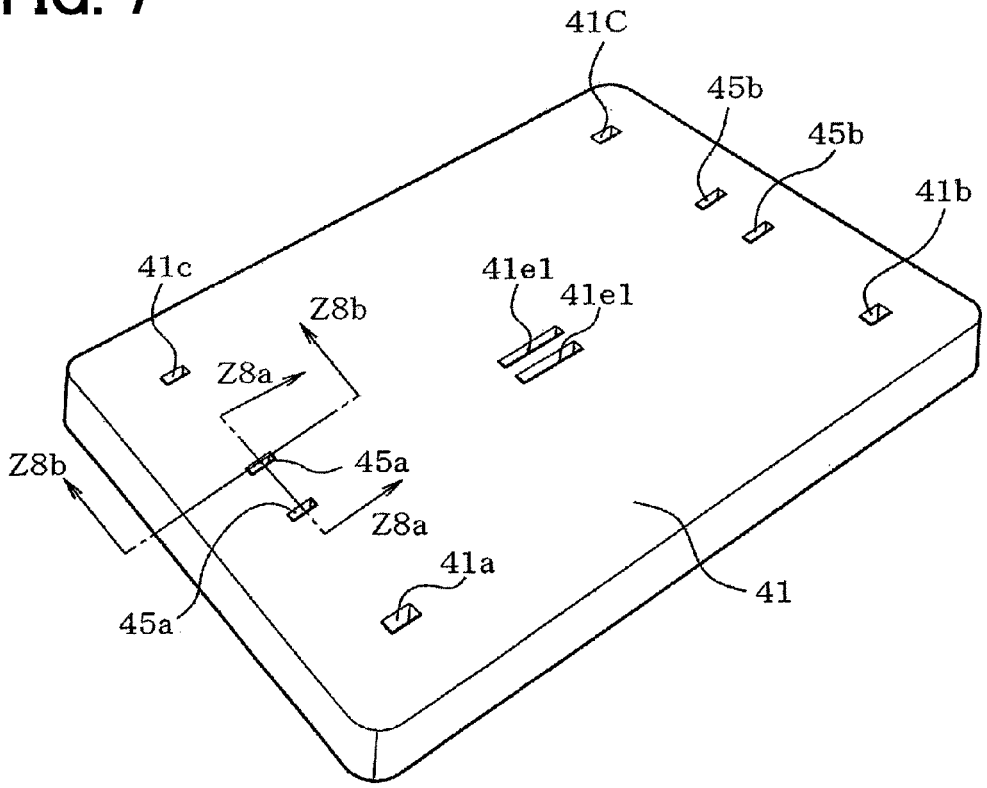
FIG. 7 is a perspective view of the operating-portion main body seen from above.
Figure 8A:
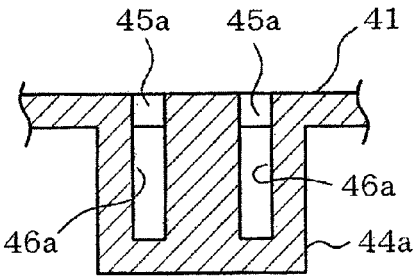
FIG. 8A is a cross-sectional view of the operating-portion main body taken along line Z8*a*-Z8*a* in FIG. 7.
Figure 8B:
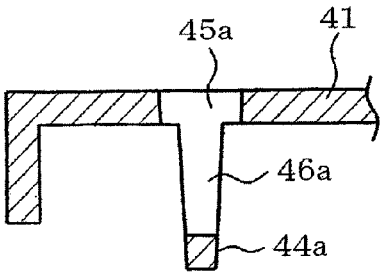
FIG. 8B is a cross-sectional view of the operating-portion main body taken along line Z8*b*-Z8*b* in FIG. 7.

As illustrated in FIG. 6, substantially rectangular stepped portions 41*a* to 41*d*, each of which has a flat lower surface, are respectively provided in four corner portions (corresponding to the respective stepped portions 31*a* to 31*d*) of a back surface portion (lower surface portion) of the operating-portion main body 41. Hole portions 41*a*1 to 41*d*1 are respectively provided to vertically pass through the stepped portions 41*a* to 41*d*, and portions of the operating-portion main body 41 corresponding to the respective stepped portions 41*a* to 41*d*.

A stepped portion 41*e* having a flat lower surface is provided in a substantially central portion (corresponding to the stepped portion 33*a*) of the back surface portion of the operating-portion main body 41. Two hole portions 41*e*1 are provided to vertically pass through the stepped portion 41*e*. A downward extending wall portion 41*f* is provided in an edge portion of the operating-portion main body 41.

Engaged claw portions 43*a* to 43*d* as engaged portions protruding downward (toward the body portion 3) are respectively provided in the vicinities (corresponding to the respective engaging hole portions 34*a* to 34*d*) of the four corner portions of the back surface portion of the operating-portion main body 41.

Rib-shaped piece portions 44*b* and 44*a* are respectively provided in right and left portions (corresponding to the respective piece-portion hole portions 35*a* and 35*b*) of the back surface portion of the operating-portion main body 41. The piece portions 44*a* and 44*b* can be respectively inserted into the piece-portion hole portions 35*a* and 35*b*.

As illustrated in FIGS. 6 to 8B, through hole portions 45*a* and 45*b* are respectively provided to pass through two portions (corresponding to base portions of the piece portions 44*a* and 44*b*, respectively) of the operating-portion main body 41 from the upper surface portion to the back surface portion.

Plug space portions 46*a* and 46*b* are provided in the operating-portion main body 41 to communicate with the through hole portions 45*a* and 45*b*, and to open to middle portions of the piece portions 44*a* and 44*b*, respectively.

Figure 4:
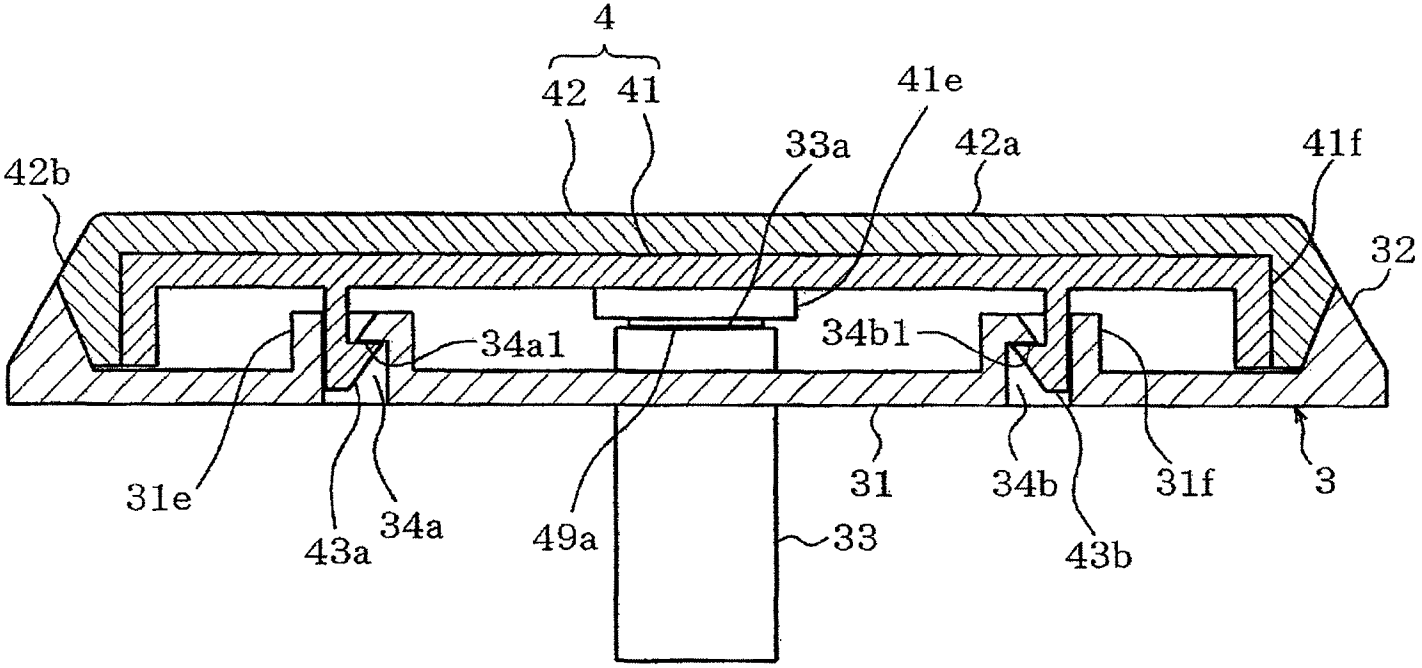
FIG. 4 is a cross-sectional view of the operating member taken along line Z4-Z4 in FIG. 2.

As illustrated in FIGS. 3 and 4, the exterior body 42 includes an exterior-body main body 42*a* having a substantially rectangular plate-like shape. A falling portion 42*b* is provided in a circumferential edge portion of the exterior-body main body 42*a*. An inner surface of the falling portion 42*b* is a surface which falls substantially straight, and an outer surface of the falling portion 42*b* has a mountain-like shape which protrudes laterally.

The exterior-body main body 42*a* is firmly fixed to the upper surface portion of the operating-body main body 41 and an outer circumferential surface of the downward extending wall portion 41*f*.

Protruding portions 48*a* to 48*d* (refer to FIG. 5) are provided in a back surface portion (lower surface portion) of the exterior-body main body 42*a*. The protruding portions 48*a* to 48*d* are respectively inserted into the hole portions 41*a*1 to 41*d*1 of the stepped portions 41*a* to 41*d*, and tip end portions of the protruding portions 48*a* to 48*d* respectively protrude from the hole portions 41*a*1 to 41*d*1. Protruding portions 49*a* and 49*a* illustrated in FIG. 5 are provided in the back surface portion (lower surface portion) of the exterior-body main body 42*a*. The protruding portions 49*a* and 49*a* are respectively inserted into the hole portions 41*e*1 and 41*e*1 of the stepped portion 41*e*, and tip end portions of the protruding portions 49*a* and 49*a* respectively protrude from the hole portions 41*e*1 and 41*e*1.

Protruding portions 50*a* and 50*b* illustrated in FIGS. 3 and 5 are provided in the back surface portion of the exterior-body main body 42*a*. The protruding portion 50*a* is continuously plugged into, and firmly fixed to the through hole portion 45*a* and the plug space portion 46*a*. A portion of the protruding portion 50*a* forms a protruding portion 51*a* protruding from both side surfaces of the piece portion 44*a*. The protruding portion 50*b* is continuously plugged into, and firmly fixed to the through hole portion 45*b* and the plug space portion 46*b*. A portion of the protruding portion 50*b* forms a protruding portion 51*b* protruding from both side surfaces of the piece portion 44*b*.

Figure 11A:
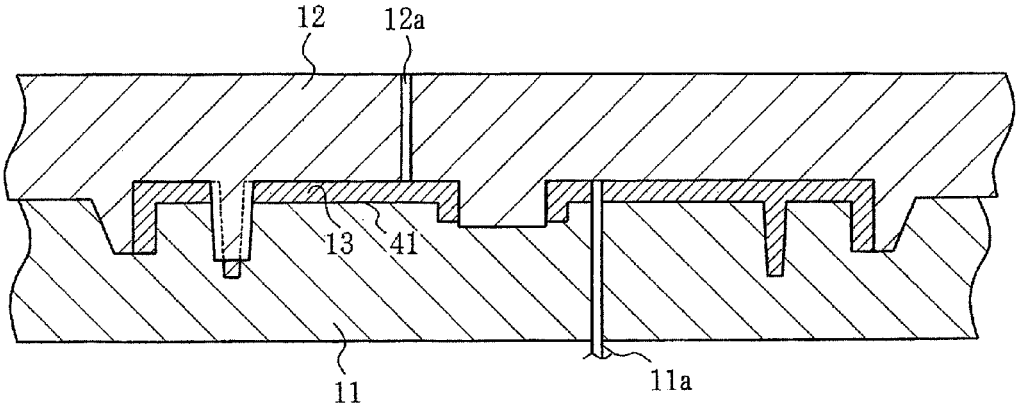
FIGS. 11A to 11C are views illustrating the sequence of molding the operating member in time series.
Figure 11B:
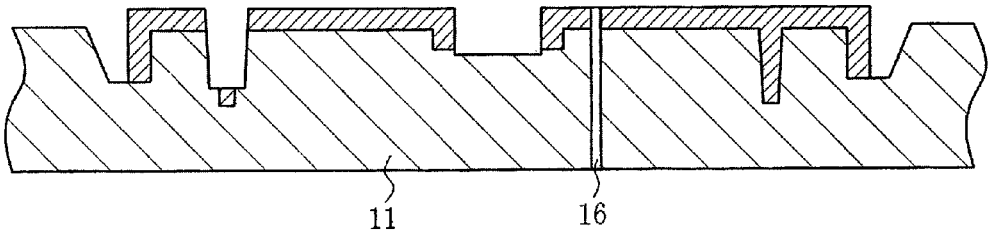
Figure 11C:
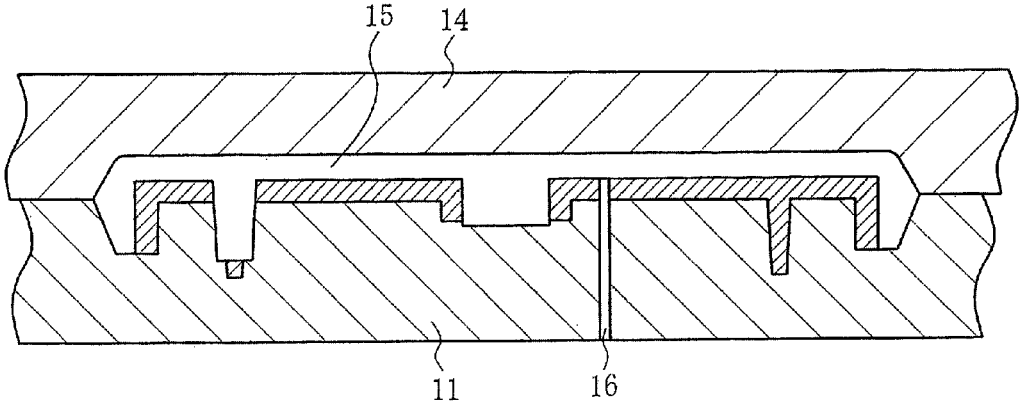

The operating-portion main body 41 and the exterior body 42 are integrally formed by die molding. The operating-portion main body 41 and the exterior body 42 are molded by the following specific manufacturing method. The operating-portion main body 41 and the exterior body 42 are molded by a manufacturing method referred to as so-called two-color molding. FIGS. 11A to 11C illustrate the schematic sequence of the two-color molding. In FIG. 11A, a cavity 13 for the operating-portion main body 41 is formed by a first die 11 and a second die 12 which can be separated from each other. The operating-portion main body 41 with the aforementioned configuration is formed (die molded) by injecting a molten ABS-resin (material of the operating-portion main body 41) material into the cavity 13 through a resin injection path 12*a* provided in the second die 12, and solidifying the injected ABS-resin material. The first die 11 includes a draft piece 11*a* for a resin injection path which can be pulled out thereof.

After the second die 12 is separated from the first die 11, and the draft piece 11*a* is pulled from the first die 11 as illustrated in FIG. 11B, a third die 14 is aligned with the first die 11 on which the operating-portion main body 41 remains, as illustrated in FIG. 11C, and a cavity 15 for the exterior body 42 is formed by the first die 11, the operating-portion main body 41, and the third die 14. A resin injection path 16 is provided in the first die 11 and the operating-portion main body 41 by pulling the draft piece 11*a* out thereof.

The exterior body 42 is formed (die molded) by injecting molten liquid of elastomer (the material of the exterior body 42) into the cavity 15 through the resin injection path 16, and solidifying the injected elastomer liquid. A portion of the exterior body 42, which comes into contact with the operating-portion main body 41, is firmly fixed to the operating-portion main body 41 by die molding such that the operating portion 4 is formed (die molded). Thereafter, the operating portion 4 is taken out of the cavity 15 by mold release.

In order to join the operating portion 4 formed in this manner to the body portion 3, the engaged claw portions 43*a* to 43*d* of the operating portion 4 are positionally aligned with the engaging hole portions 34*a* to 34*d* of the body portion 3, respectively. In addition, at this time, the piece portions 44*a* and 44*b* are positionally aligned with the piece-portion hole portions 35*a* and 35*b*, respectively. The operating portion 4 is pressed against the body portion 3. Therefore, the engaged claw portions 43*a* to 43*d* of the operating portion 4 are respectively inserted into and engaged with the engaging hole portions 34*a* to 34*d* of the body portion 3. In addition, at the same time, the piece portions 44*a* and 44*b* are respectively inserted into the piece-portion hole portions 35*a* and 35*b*.

Since the protruding portions 51*a* and 51*b* protruding from the piece portions 44*a* and 44*b* are firmly fixed to the piece portions 44*a* and 44*b*, respectively, even if a certain level of press-fit resistance is applied to the protruding portions 51*a* and 51*b*, the protruding portions 51*a* and 51*b* together with the piece portions 44*a* and 44*b* are respectively inserted into the piece-portion hole portions 35*a* and 35*b*.

Figure 9:
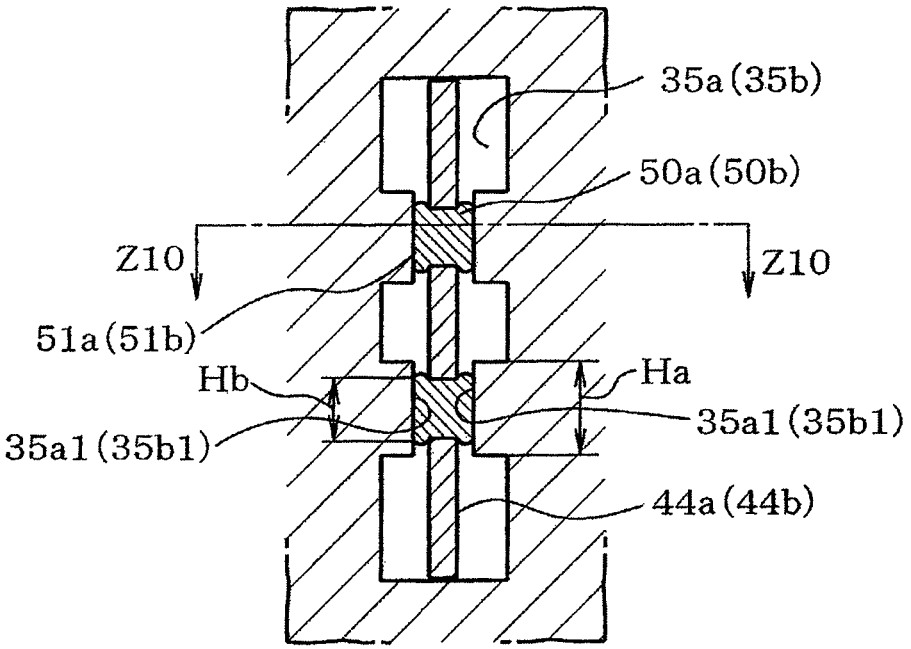
FIG. 9 is a cross-sectional view of the operating member taken along line Z9-Z9 in FIG. 3.

The protruding portions 51*a* and 51*b* respectively come into press contact with the protruding portions 35*a*1 and 35*b*1, which are inner edge portions of the piece-portion hole portions 35*a* and 35*b*, while being elastically deformed (refer to FIGS. 3, 9, and 10).

Since the inner surfaces of each of the protruding portions 35*a*1 and 35*b*1 are disposed to form a tapered shape from the viewpoint of mold release, as illustrated in FIG. 10, the protruding portions 51*a* and 51*b* are respectively bitten by upper edge portions of the protruding portions 35*a*1 and 35*b*1. Portions of the protruding portions 51*a* and 51*b* respectively bitten by the protruding portions 35*a*1 and 35*b*1 are settled (undergo a decrease in elasticity, or plastic deformation) due to press fitting and stress. Accordingly, the movement of the upper edge portions of the protruding portions 35*a*1 and 35*b*1 is stopped by the settled portions of the protruding portions 51*a* and 51*b*. As a result, the body portion 3 and the operating portion 4 are joined together without wobbling relative to each other in the vertical direction, a rightward and leftward direction, and a forward and rearward direction.

When the body portion 3 and the operating portion 4 are joined together, the protruding portions 48*a* to 48*d* protruding from the stepped portions 41*a* to 41*d* of the operating-portion main body 41 are proximate to or in contact with the stepped portions 31*a* to 31*d*, respectively. Similarly, the protruding portions 49*a* and 49*a* protruding from the stepped portion 41*e* are proximate to or in contact with the stepped portion 33*a*. Accordingly, even if the operating portion 4 is operated and pressed toward the body portion 3, sound due to contact between the operating portion 4 and the body portion 3 does not occur.

A user touches the exterior body 42 with the hand and fingers, and operates the operating member 1 with the aforementioned configuration in an arbitrary direction. Since the exterior body 42 is made of an elastic material, the exterior body 42 is well fitted to the hand and fingers, and improved ease of use is obtained.

In the embodiment, the operating member 1 in which the body portion 3 and the operating portion 4 are joined together by engagement of the engaged claw portions 43*a* to 43*d* with the respective engaging hole portions 34*a* to 34*d* includes the piece portions 44*a* and 44*b* provided in the back surface portion (back surface portion of the operating portion 4) of the operating-portion main body 41 so as to protrude toward the body portion 3; the piece-portion hole portions 35*a* and 35*b* provided in the body portion 3 and into which the piece portions 44*a* and 44*b* are respectively inserted; and the protruding portions 51*a* and 51*b* made of an elastic material that are provided to respectively protrude from the side surfaces of the piece portions 44*a* and 44*b*, and respectively come into press contact with the edge portions of the protruding portions 35*a*1 and 35*b*1, which are the edge portions of the piece-portion hole portions 35*a* and 35*b*, when the piece portions 44*a* and 44*b* are respectively inserted into the piece-portion hole portions 35*a* and 35*b*.

In this configuration, when the body portion 3 and the operating portion 4 are joined together, the piece portions 44*a* and 44*b* of the operating portion 4 are respectively inserted into the piece-portion hole portions 35*a* and 35*b* of the body portion 3. At this time, the protruding portions 51*a* and 51*b*, which are made of an elastic material and protrude from both side surfaces of each of the respective piece portions 44*a* and 44*b*, respectively come into press contact with the edge portions of the protruding portions 35*a*1 and 35*b*1 of the piece-portion hole portions 35*a* and 35*b*. Accordingly, wobbling between the body portion 3 and the operating portion 4 during operation can be prevented.

The body portion 3 and the operating portion 4 can be simply and easily joined together by engagement of the engaged claw portions 43*a* to 43*d* with the respective engaging hole portions 34*a* to 34*d*. As a result, the operating member 1 can be simply and easily assembled. Since wobbling is prevented by press contact between the protruding portions 51*a* and 51*b* made of an elastic material and the edge portions of the respective piece-portion hole portions 35*a* and 35*b*, even if a very small vertical gap is present between the engaged claw portions 43*a* to 43*d* and the respective locking portions 34*a*1 to 34*d*1 of the engaging hole portions 34*a* to 34*d*, the vertical gap causes no issues. When the engaged claw portions 43*a* to 43*d* are respectively press-engaged with the locking portions 34*a*1 to 34*d*1 of the engaging hole portions 34*a* to 34*d* without a vertical gap therebetween, and when the operating member 1 is slid, a creaking sound may occur, and thus the press engagement is preferably avoided.

In the present embodiment, the operating portion 4 is configured to include the operating-portion main body 41 and the exterior body 42 made of an elastic material and fixed to the upper surface portion of the operating-portion main body 41. Since the hand and fingers of the user come into contact with the exterior body 42 made of an elastic material in this configuration, the exterior body 42 is well fitted to the hand and fingers, and improved ease of use is obtained.

In the present embodiment, the protruding portions 50*a* and 50*b*, which are a portion of the exterior body 42, are respectively continuously plugged into, and firmly fixed to the through hole portions 45*a* and 45*b* and the plug space portions 46*a* and 46*b* of the operating-portion main body 41, and the portions of the protruding portions 50*a* and 50*b* respectively form the protruding portions 51*a* and 51*b* protruding from both side surfaces of the piece portions 44*a* and 44*b*. Therefore, the protruding portions 51*a* and 51*b* can be formed on an upper surface portion side of the operating-portion main body 41 by using the exterior body 42 configured to improve ease of use.

In the present embodiment, since the protruding portions 51*a* and 51*b* are respectively plugged into and firmly fixed to the plug space portions 46*a* and 46*b* of the piece portions 44*a* and 44*b*, when the piece portions 44*a* and 44*b* are respectively inserted into the piece-portion hole portions 35*a* and 35*b*, the protruding portions 51*a* and 51*b* can also be integrally (without being offset from the respective piece portions 44*a* and 44*b*) pressed into the piece-portion hole portions 35*a* and 35*b*, and reliably come into press contact with the edge portions of the piece-portion hole portions 35*a* and 35*b*, that is, the edge portions of the protruding portions 35*a*1 and 35*b*1, respectively. Accordingly, wobbling between the body portion 3 and the operating portion 4 during operation can be reliably prevented.

In the present embodiment, the operating-portion main body 41 and the exterior body 42 are integrally formed by die molding. Accordingly, the exterior body 42 can easily be firmly fixed to the operating-member 41.

In the present embodiment, according to the adopted method (so-called two-color molding method) of manufacturing the operating portion 4 (configured to include the operating-portion main body 41 and the exterior body 42) of the operating member 1, the operating-portion main body 41 is die molded by injecting molten resin liquid into the cavity 13 for the operating-portion main body 41, which is formed by the first die 11 and the second die 12 which can be separated from each other. Thereafter, the second die 12 is separated from the first die 11, and the separable third die 14, which forms the cavity 15 for the exterior body 42 together with the first die 11 and the operating-portion main body 41, is aligned with the first die 11 on which the operating-portion main body 41 remains. Then, the exterior body 42 is firmly fixed to the operating-portion main body 41 by die molding using the first die 11, the operating-portion main body 41, and the third die 14 by injecting molten resin liquid into the cavity 15.

In this manner, the operating-portion main body 41 and the exterior body 42 can be molded by three dies such as the first die 11, the second die 12, and the third die 14. By the way, when two members are die molded, two dies (a total of four dies) are required for each member. In contrast, in the present embodiment, the operating-portion main body 41 and the exterior body 42 can be die molded using a smaller number of dies.

Since this manufacturing method is a two-color molding method, the exterior body 42 can be reliably and firmly fixed to the operating-portion main body 41. As a result, when the piece portions 44*a* and 44*b* are respectively inserted into the piece-portion hole portions 35*a* and 35*b*, even if the protruding portions 51*a* and 51*b* of the piece portions 44*a* and 44*b* respectively come into contact with the edge portions of the piece-portion hole portions 35*a* and 35*b*, the separation of the protruding portions 51*a* and 51*b* from the respective piece portions 44*a* and 44*b* can be avoided.

According to this manufacturing method, since the inner surfaces (inner surfaces of the protruding portions 35*a*1 and 35*b*1) of the piece-portion hole portions 35*a* and 35*b* are disposed to form a tapered shape from the viewpoint of die molding, the protruding portions 51*a* and 51*b* respectively come into press contact with the protruding portions 35*a*1 and 35*b*1 while being respectively bitten by the upper edge portions of the protruding portions 35*a*1 and 35*b*1. The portions of the protruding portions 51*a* and 51*b* bitten by the upper edge portions of the protruding portions 35*a*1 and 35*b*1 undergo plastic deformation due to the press contact, and thus, vertical engagement can become more firm, and vertical wobbling can be more reliably prevented. In this case, the movement in the forward and rearward direction and the rightward and leftward direction is also stopped.

The exterior body 42 may be integrally die molded (referred to as so-called mold forming) with the operating-portion main body 41 by die molding the operating-portion main body 41 alone, disposing the operating-portion main body 41 in separate upper and lower dies, and then injecting molten elastomer liquid for the exterior body 42 into the upper and lower dies.

In a method other than the method of firmly fixing the operating-portion main body 41 and the exterior body 42 together by integral die molding, the operating-portion main body 41 and the exterior body 42 may be separately formed, and bonding portions of the operating-portion main body 41 and the exterior body 42 may be bonded together using an adhesive.

Figure 12:
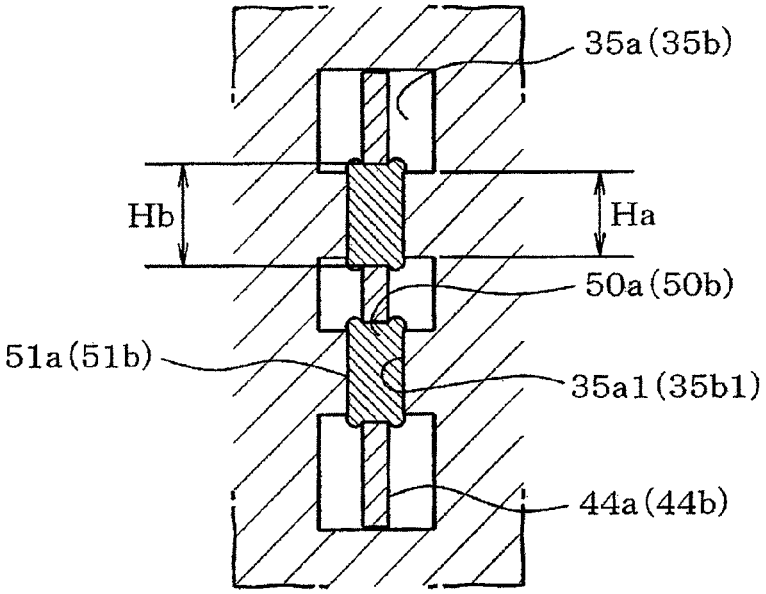
FIG. 12 is a view equivalent to FIG. 9 illustrating a second embodiment.

In the present embodiment, as illustrated in FIG. 9, a width dimension Ha of each of the protruding portions 35*a*1 and 35*b*1 is greater than a width dimension Hb of each of the protruding portions 51*a* and 51*b*; however, Ha may be set to be less than Hb as in a second embodiment illustrated in FIG. 12. One protruding portion 51*a* (51*b*) may be provided on one side surface of the piece portion 44*a* (44*b*), and in this case, the protruding portion 51*a* (51*b*) may be formed to have a greater width dimension. The protruding portion 35*a*1 (35*b*1) of the piece-portion hole portion 35*a* (35*b*) may not be provided. In this case, the piece-portion hole portion 35*a* (35*b*) may be formed to have a width dimension equivalent to that of the protruding portion 35*a*1 (35*b*1).

Figure 13:
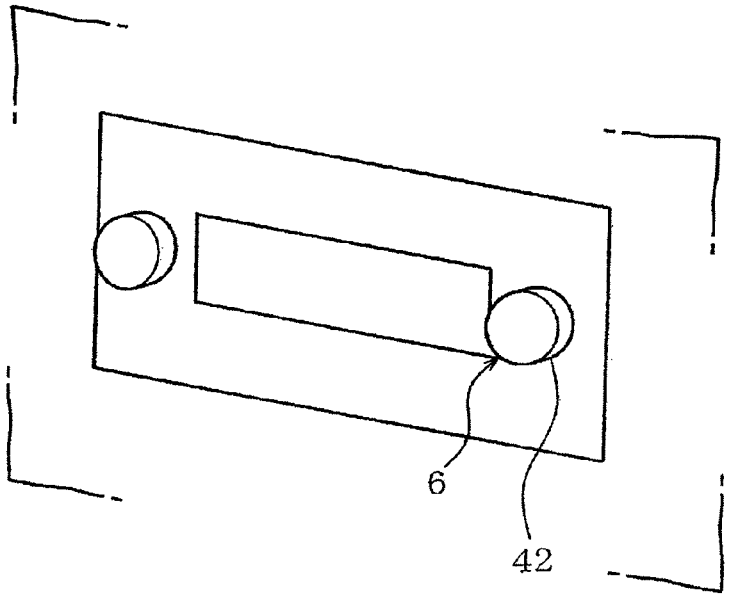
FIG. 13 is a perspective view of an audio device in a third embodiment.
Figure 14:
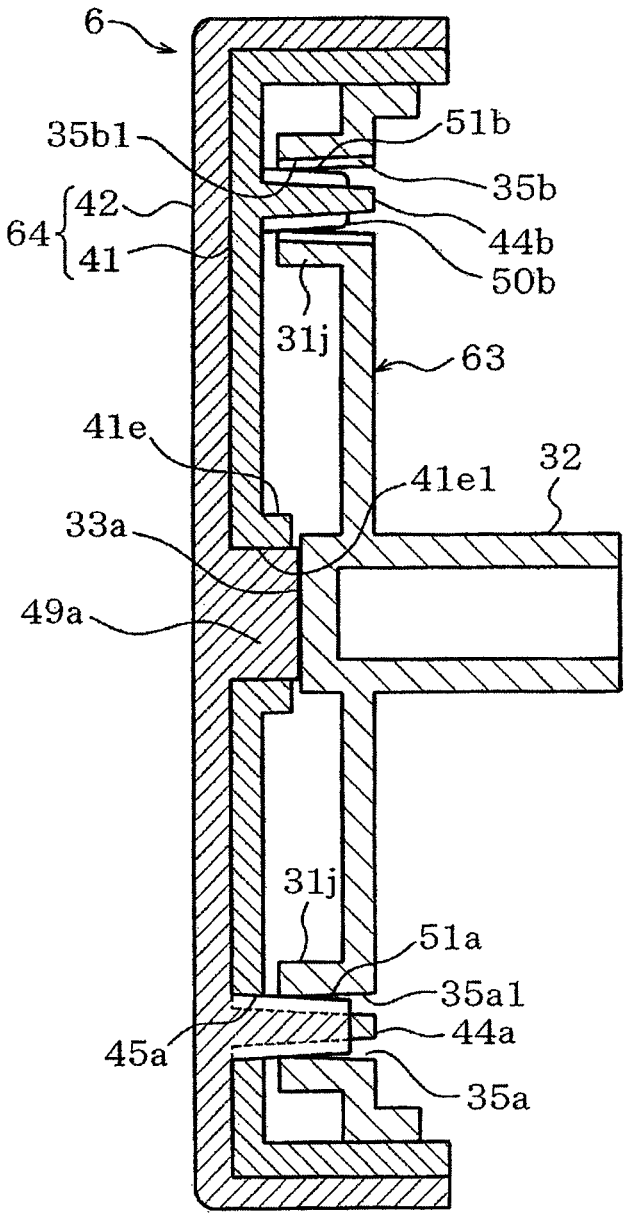
FIG. 14 is a cross-sectional view of an operating member.
Figure 15:
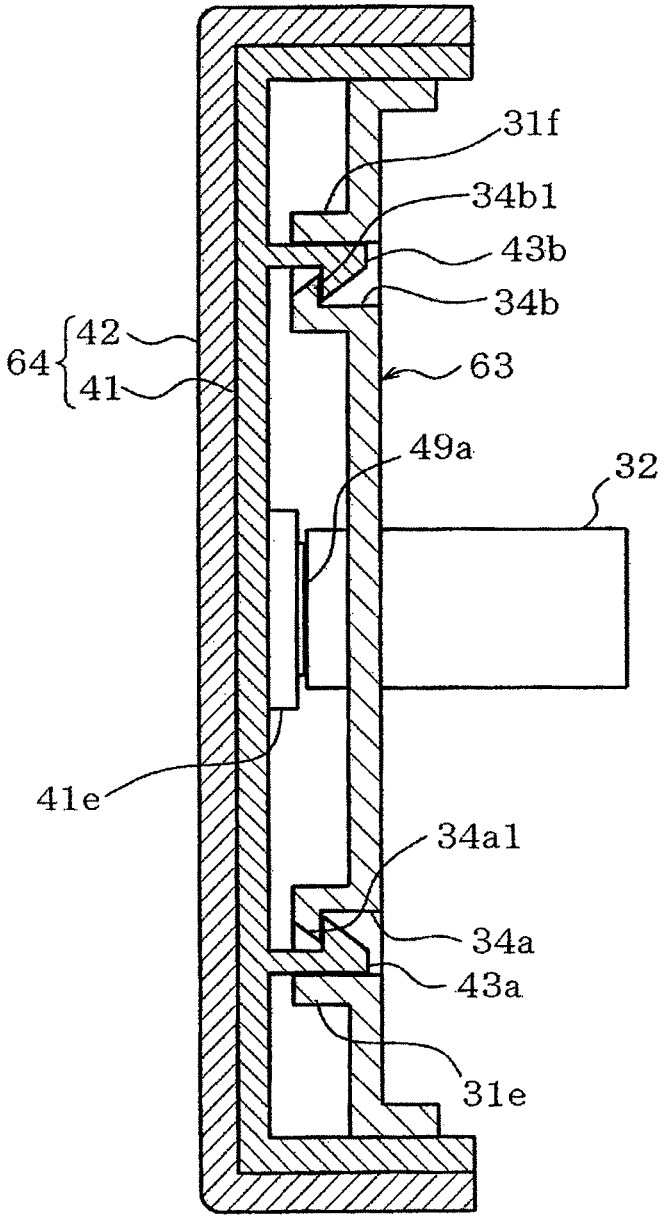
FIG. 15 is a cross-sectional view of the operating member in which a section different from that in FIG. 14 is taken.

In the embodiment, the operating member 1 for a car navigation device is exemplarily described; however, the present disclosure may be applied to an operating member 6 equivalent to an operating knob of an audio device in a third embodiment illustrated in FIGS. 13 to 15. In this case, the operating member 6 can be operated in a push manner and a rotating manner. A body portion 63 and an operating portion 64 of the operating member 6 have a circular exterior shape. In FIGS. 13 to 15, the same reference signs are assigned to the same functional portions as in the first embodiment.

The shapes of the engaging portion and the engaged portion are not limited to those in the embodiment. The engaging portion may be formed as a claw portion, and the engaged portion may be formed as a hole portion.

The embodiments of the present disclosure can be applied to not only vehicle equipment but also operating members for general equipment.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. An operating member comprising:

a body portion;

an operating portion connected to the body portion;

an engaging portion arranged in the body portion;

an engaged portion arranged in the operating portion, and engaged with the engaging portion to connect the body portion and the operating portion;

a piece portion arranged on a back surface portion of the operating portion and protruding toward the body portion;

a piece-portion hole arranged in the body portion, into which the piece portion is inserted; and a protruding portion made of an elastic material, arranged on the piece portion, protruding from a side of the piece portion and press-contacting an edge portion inner surface of the piece-portion hole.

2. The operating member according to claim 1, wherein:

the operating portion includes an operating-portion main body and an exterior body made of an elastic material and fixed to a front surface portion of the operating-portion main body;

the engaged portion is arranged in the operating-portion main body;

the piece portion is arranged on a back surface portion of the operating-portion main body;

the operating-portion main body includes a through hole arranged in a portion of the operating-portion main body corresponding to a base portion of the piece portion and penetrating from the front surface portion to the back surface portion of the operating-portion main body, and a plug space portion-communicating with the through hole and opening to a middle portion of the piece portion; and a portion of the exterior body is continuously plugged into and fixed to the through hole and the plug space portion, and the portion of the exterior body fixed to the plug space portion provides the protruding portion protruding from the side of the piece portion.

3. The operating member according to claim 2, wherein:

the operating-portion main body and the exterior body are integrated in a die molding manner.

4. An operating member comprising:

a body portion;

an operating portion connected to the body portion;

an engaging portion arranged in the body portion;

an engaged portion arranged in the operating portion, and engaged with the engaging portion to connect the body portion and the operating portion;

a piece portion arranged on a back surface portion of the operating portion and protruding toward the body portion;

a piece-portion hole arranged in the body portion, into which the piece portion is inserted; and a protruding portion made of an elastic material, arranged on the piece portion, protruding from a side of the piece portion and press-contacting an edge portion of the piece-portion hole, wherein:

the operating portion includes an operating-portion main body and an exterior body made of an elastic material and fixed to a front surface portion of the operating-portion main body;

the engaged portion is arranged on the operating-portion main body;

the piece portion is arranged on a back surface portion of the operating-portion main body;

the operating-portion main body includes a through hole arranged in a portion of the operating-portion main body corresponding to a base portion of the piece portion and penetrating from the front surface portion to the back surface portion of the operating-portion main body, and a plug space portion communicating with the through hole and opening to a middle portion of the piece portion; and a portion of the exterior body is continuously plugged into and fixed to the through hole and the plug space portion, and the portion of the exterior body fixed to the plug space portion provides the protruding portion protruding from the side of the piece portion.

5. The operating member according to claim 4, wherein:

the operating-portion main body and the exterior body are integrated in a die molding manner.

6. A method of manufacturing an operating portion of an operating member, which includes:

a body portion;

an operating portion including an operating-portion main body and an exterior body made of an elastic material and fixed to a front surface portion of the operating-portion main body, and connected to the body portion;

an engaging portion arranged in the body portion;

an engaged portion arranged in the operating-portion main body, and engaged with the engaging portion to connect the body portion and the operating portion;

a piece portion arranged on a back surface portion of the operating-portion main body, and protruding toward the body portion; and a piece-portion hole arranged in the body portion, into which the piece portion is inserted, the operating-portion main body including a through hole arranged in a portion of the operating-portion main body corresponding to a base portion of the piece portion and penetrating from the front surface portion to the back surface portion of the operating-portion main body, and a plug space portion communicating with the through hole and opening to a middle portion of the piece portion, a portion of the exterior body being continuously plugged into and fixed to the through hole and the plug space portion, the portion of the exterior body fixed to the plug space portion providing a protruding portion protruding from the side of the piece portion, the protruding portion press-contacting an edge portion of the piece-portion hole when the piece portion is inserted into the piece-portion hole, the method of manufacturing the operating portion of the operating member comprising:

die molding the operating-portion main body with a first die and a second die, which are separable from each other and provide a cavity for the operating-portion main body;

separating the second die from the first die;

die matching the first die, on which the operating-portion main body remains, with a separable third die for providing a cavity for the exterior body using the first die and the operating-portion main body; and die molding and fixing the exterior body to the operating-portion main body using the first die, the operating-portion main body and the third die.

* * * * *